United States Patent [19]

Frangipane

[11] 4,151,685

[45] May 1, 1979

[54] GRINDING WHEEL

[76] Inventor: Joseph G. Frangipane, 312 Graham Dr., Clearwater, Fla. 33515

[21] Appl. No.: 646,956

[22] Filed: Jan. 7, 1976

Related U.S. Application Data

[63] Continuation-in-part of Ser. No. 516,642, Oct. 21, 1974, Pat. No. 3,951,619, and a continuation-in-part of Ser. No. 359,314, May 11, 1973, abandoned.

[51] Int. Cl.[2] ..... B24D 5/02

[52] U.S. Cl. ..... 51/207; 51/206 P

[58] Field of Search ..... 51/206 R, 206 P, 206.4, 51/206.5, 207, 98 R; 76/89.1

[56] References Cited

U.S. PATENT DOCUMENTS

| | | | |
|---|---|---|---|
| 1,000,813 | 8/1911 | Johnson | 51/207 |
| 1,045,016 | 11/1912 | George | 51/206 P |
| 1,435,514 | 11/1922 | Burns | 76/89.1 |
| 1,904,274 | 4/1933 | Crowley | 51/92 R |
| 3,143,829 | 8/1964 | Brauchle | 51/98 R |

FOREIGN PATENT DOCUMENTS

| | | | |
|---|---|---|---|
| 1116027 | 10/1961 | Fed. Rep. of Germany | 51/206 P |
| 261227 | 11/1926 | United Kingdom | 51/206 P |
| 885185 | 11/1960 | United Kingdom | 51/285 |

*Primary Examiner*—Gary L. Smith

[57] ABSTRACT

A grinding wheel has a series of deep and narrow circumferential grooves between circular grinding sections having radially convex surfaces for forming serrations in a knife edge. The grooves are filled with a non-abrasive substance to strengthen the wheel and prevent a build-up of serrating grinding off-fall as well as providing an indication by sound and feel when grinding of the serrations in a knife edge is completed. One embodiment has a plurality of abrasive discs mounted on a holder with smaller diameter non-abrasive discs between each of the abrasive discs, to form grooves therebetween. The holder forms a hub for mounting the assembled wheel on a spindle. A second embodiment has a vitrified abrasive which is pressed to form a blank with a cylindrical outer surface and a hub portion for receiving a spindle. The blank is fired to a relatively low temperature so that it may be mounted on a spindle as narrow annular grooves are cut through its cylindrical surface, and the outer faces of the abrasive sections between the grooves are dressed to a convex radius half the thickness of the abrasive sections. The grooves are then filled with a non-abrasive material to a diameter less than that of the abrasive sections and the wheel is fired to a relatively high temperature to give the abrasive sections desired hardness.

6 Claims, 5 Drawing Figures

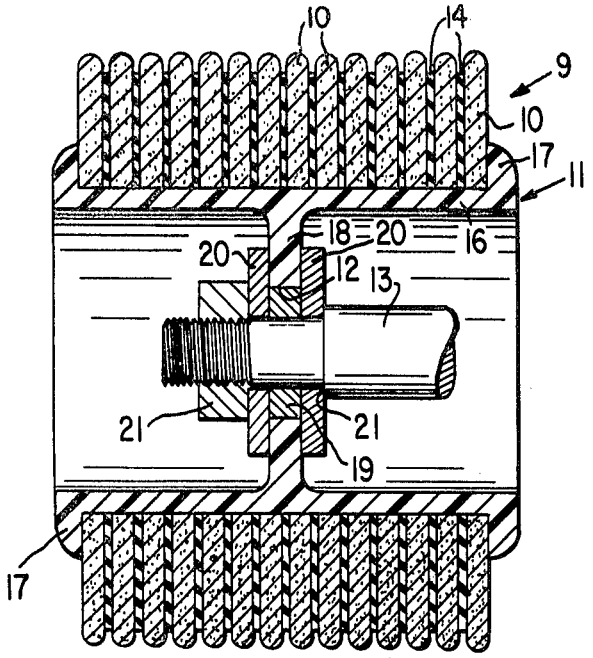
FIG. 1
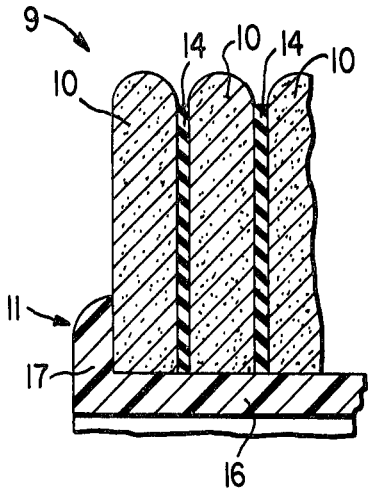
FIG. 2
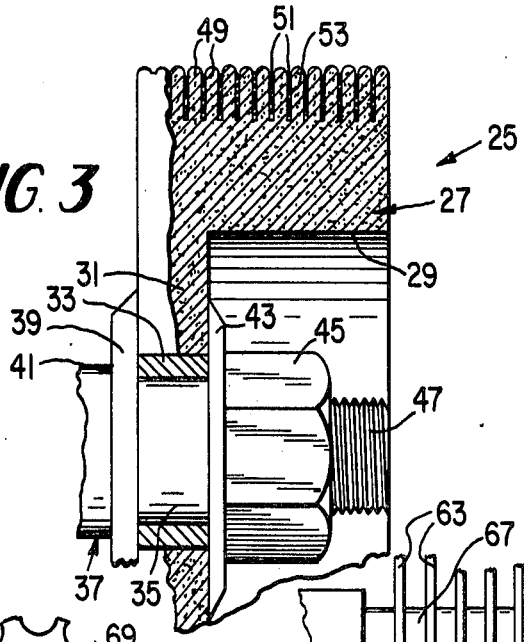
FIG. 3
FIG. 4
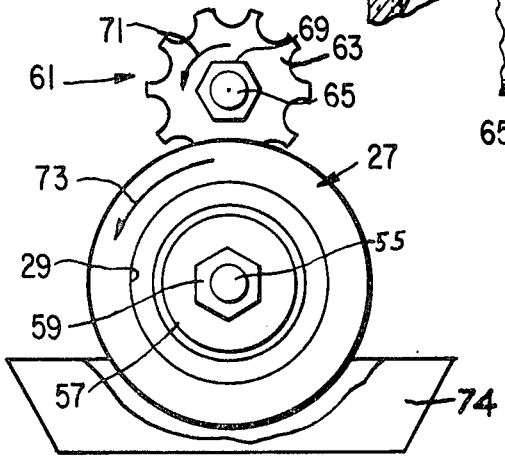
FIG. 5
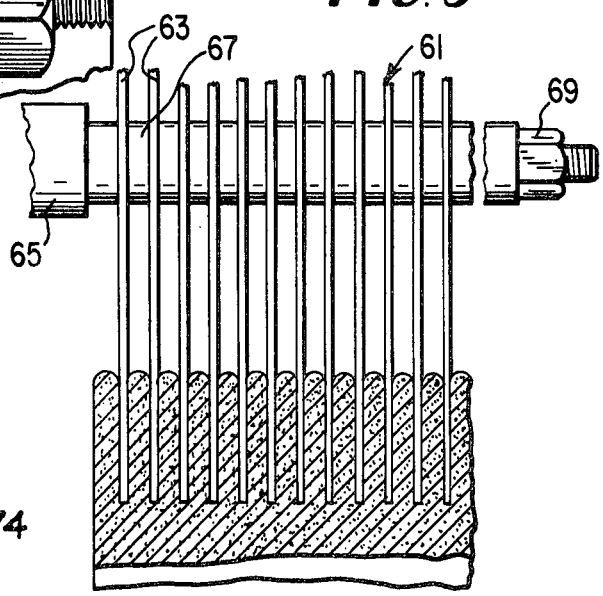

GRINDING WHEEL

This application is a continuation-in-part of my co-pending application Ser. No. 516,642, filed Oct. 21, 1974, now Pat. No. 3,951,619, granted Apr. 20, 1976, and was co-pending with and is a continuation in part of my earlier application Ser. No. 359,314, filed May 11, 1973, now abandoned.

This invention relates to grinding wheels and, more particularly, to wheels for serrating knives.

BACKGROUND OF THE INVENTION

A conventionally ridged grinding wheel initially contacts a work piece at the outer most portion of the ridges of the grinding surface. Since there is no contact between the valley portions of the grinding wheel and the work piece until the work piece has been ground to a substantial depth by the ridges, the ridges are subjected to wear during the entire grinding operation, whereas the valley portions are subject to wear only after grinding of the work piece is substantially completed. This action normally causes rapid wear of the ridges and causes them to lose their desired shape, requiring frequent redressing of the wheel if a particular configuration of the ridges is essential.

It is well known to produce a series of scallops or grooves, commonly called serrations, along knife edges and similar articles, by means of grinding wheels having a surface configuration complementary to the final shape of the serrations in the knife. Heretofore, the expense of frequent re-dressing to restore the desired shape of the ridges of the grinding wheel has been substantial, to such an extent that the cost has frequently precluded the use of serrations or other grooved surfaces or edges where they would be desirable.

It is well known that the common cylindrical surface of a grinding wheel normally becomes convexly arched with continued use and must be dressed from time to time in order to restore the desired cylindrical grinding surface. With grinding wheels having a series of circumferential ridges along their grinding surface, the ridges flatten out during use. Upon continued use of the wheel the entire grinding surface begins to arch convexly. Thus, such ridged wheels must be frequently re-dressed to restore the desired configuration of the ridges.

A "Tooling Device for Stone and the Like" is shown in a patent granted in 1911, U.S. Pat. No. 1,000,813, in which a series of abrasive discs are mounted on a rotary shaft, each of the discs having a convexly arched grinding surface which together form a corrugated or crimped surface for providing a fluted surface on a work piece such as a stone, to resemble a tooling effect. During continued use of the assembled discs, the ridges will be flattened and it will be necessary to re-dress the discs in order to obtain the desired tooling effect.

A "Sharpening Device for Bush Hammers" is shown in a 1912 patent, U.S. Pat. No. 1,045,016. A series of convexly beveled, V-shaped grinding surfaces are spaced slightly apart by paper discs and are clamped together by wooden discs at either end, the wooden discs being clamped between a nut and a stop collar held by a set screw. Aside from the series of discs being likely to loosen, the V-shaped ridges will lose their points and the abrasive segments will become arched so that re-dressing will be required. Also, the paper discs are likely to be ripped apart when engaged by the points formed on the work piece during the grinding operation.

A cylindrical surfaced grinding wheel having an annular groove is shown in a 1946 patent, U.S. Pat. No. 2,396,505. The stated function of the groove is to relieve stresses during grinding of a resilient work piece and to equalize wear of the grinding surfaces. Typically, the cylindrical grinding surfaces can be expected to become arched during continued use. The wheel is manufactured by filling one half of a cylindrical mold and then placing a pair of semi-cylindrical metal spacing plates on top of the abrasive fill, then filling the rest of the mold with the abrasive fill and pressing the abrasive fill. Finally, the semi-cylindrical plates may be removed, thus forming the groove.

"Grinding or Polishing Rollers for Glass and the Like" is shown in a British patent accepted in 1926, British Pat. No. 261,227, in which cylindrical cast iron or Carborundum rollers, or the like, are provided with grooves. The grooves are not filled and are intended to permit water to flow away from the cylindrical surfaces for removing grinding or polishing substances.

Additional patents of a generally related nature include: U.S. Pat. Nos. 925,546; 1,963,154; 1,975,070; 1,984,936; 2,079,787; 2,467,596; and 2,705,194.

THE INVENTION, IN BRIEF

It is a primary object of this invention to provide a new and useful grinding wheel.

Another object is provision of a new and useful grinding wheel having a grinding surface with a series of ridges which will retain their shape for long periods of grinding, if not indefinitely.

Still another object is to provide a new and useful grinding wheel which provides a signal when a work piece has been ground to a desired amount.

A still further object is provision of a new and useful serrating grinding wheel in which the grinding surface of the wheel comprises a series of ridges with deep grooves between the ridges. A related object is provision of such grooves having a width which is a bare minimum to avoid grinding of excessively long points on a work piece.

A more specific object is provision of a new and useful grinding wheel particularly suited for serrating knife edges, or the like. A related object is provision of such a grinding wheel which may be used for long periods, if not indefinitely, without re-dressing of the grinding surface of the wheel in order to provide a desired configuration of the serrations. A further related object is provision of such a grinding wheel having deep grooves between ridges which are convexly arched to form circumferential grinding surfaces which are generally semi-circular in cross-section axially of the wheel. Another related object is provision in the grooves of a relatively non-abrasive filler material. Still another related object is provision for providing a signaling when the grinding operation is completed, and for preventing a build-up in the grooves of off-fall from the grinding operation.

The invention is, in brief, directed to rotary serrating grinding wheel. The wheel has a plurality of abrasive grinding sections having convexly arched grinding surfaces and deep annular grooves between the segments, the grooves being filled with a relatively non-abrasive material. Preferably, the convexly arched grinding surfaces of the sections are preferably formed to a radius half the diameter of the width of the sections.

Additional objects and advantages of the invention will be apparent in the following description and the accompanying drawing.

BRIEF DESCRIPTION OF THE DRAWING

FIG. 1 is a schematic, diametrical sectional view of an embodiment a grinding wheel of the invention;

FIG. 2 is an enlarged, fragmentary sectional view of a portion of FIG. 1;

FIG. 3 is a fragmentary, schematic, diametrical sectional view of a preferred embodiment of the grinding wheel;

FIG. 4 is a schematic end view, illustrating a grooving step during manufacture of the wheel shown in FIG. 3; and FIG. 5 is an enlarged, fragmentary, schematic side view of FIG. 4.

DESCRIPTION OF THE ILLUSTRATED EMBODIMENTS

Referring to FIGS. 1 and 2 of the drawing, a grinding wheel 9 has a group of similar annular abrasive grinding sections or discs 10 apertured for mounting on a hub 11 which includes a bore 12 mounted for rotation on a driving shaft 13. Each of the grinding discs 10 has its outer circumferential surface convexly arched and, more particularly, arched along a radius equal to half the thickness of the grinding discs 10. Grinding discs 10 have a diameter of about six inches and the overall width of the grinding surface of the wheel 9 being about two and one half inches.

Each grinding disc 10 is separated from the adjacent grinding discs by a relatively non-abrasive separator 14 of less diameter to provide grooves between the discs 10. The proportion between the thickness of the grinding discs 10 and the separator disc 14 may be as desired for the intended function of the grinding wheel. For serrating the edges of steak knives, for example, the width proportion of the grinding discs 10 to the separator discs 14 is about 19 to 1 and, more particularly, for grinding 10 serrations per inch each grinding segment 9 should be 0.095" in thickness and the separator discs 14 should be about 0.005" in thickness. A suitable adhesive, such as a rubber cement, may be utilized to form a mechanical bond between the discs 10 and 14 and between the discs and the drum 16 and flanges 17.

The hub 11 is preferably made of a durable plastic of the polyvinyl chloride type, and has a drum 16 proportioned to fit closely within the inside diameters of the discs 10 and 14, with flanges 17 of the hub fitting tightly over the outside grinding discs 10. The hub 11 has a central web 18 fitted with an annular metal bushing 19 for a snug sliding fit on the shaft 13 between a pair of rigid washers 20, one of the washers being seated against a shoulder 21 on the shaft 13 and the other washer being seated against a nut 21 threaded onto the free end of the shaft 13 and firmly clamping the hub 11 onto the shaft.

The non-abrasive separator discs 14 perform several functions. Their chief function is to wear away at a faster rate than the grinding discs 10 in order to maintain a suitable desired difference between the outer diameter of the abrasive discs and the outer diameter of the separator discs.

Another function is to signal by a change in the "feel" and/or the sound of the grinding operation, when the grinding operation has proceeded to a desired stage, that is, the work piece has been serrated to the desired depth. At this time the projecting portions of the serrations of the work piece have their very first contact with the separator discs 14. This contact with the separator discs 14 produces a slight rubbing vibration which feels and sounds different from the preceding abrasive action of the grinding discs 10.

The method of making the grinding wheel 9 includes, by way of example and not limitation, providing twenty-five grinding disc 10 with the outside circumference of these discs convexly arch, preferably to a radius of half that of the thickness of the discs. Also, providing twenty-four separator discs 14 either coated with a waterproof adhesive such as rubber cement or, alternatively, made of material which has previously been impregnated with a suitable waterproof adhesive. The grinding discs 10 and the separator discs 14 are then alternately placed on a mandrel which closely fits the inside diameter of the discs. This assembly is then cured by being placed in a press and held under adequate pressure to achieve a suitable desired compression and final thickness of the separator discs 14. This pressure is continued from one to twenty minutes, depending on the curing characteristics of the adhesive, plus the porosity of the grinding discs 10 and the separator discs 14, and this time may vary depending on ambiant temperature.

After curing, the assembled stack is next slipped over the adhesive coated drum 16 of the hub 11. The flanges 17 are formed thereon by heat and pressure as is well known in the plastics art. Alternatively, the assembled stack may be inserted into a mold and the hub 11 molded directly onto the stack.

It has been found that grinding wheels made by the described method retain the desired radial configuration of the ridges of the outer circumferential surfaces of the discs 10. The discs 10 retain their radial ridged configuration as their diameter is progressively reduced during use, thereby eliminating the periodic re-dressing as has heretofore been necessary.

Thus, the described shape of the working faces of the grinding discs 10 provides a desirable relationship for the retention of the radial configuration throughout the wearing life of the grinding wheel. It has been found that without the separator discs 14, the arched configuration of the outer circumferential surface of the grinding discs 10 eventually flatten out into a generally cylindrical configuration, as previously discussed. As the outer diameters of the grinding discs 10 are reduced, the outer diameters of the separator discs 14 are also reduced as the work piece cuts into the separator disc 14, thus retaining discreet grooves between the grinding discs 10.

Referring to FIG. 3 of the drawing, a grinding wheel 25 is illustrated in the form of a generally cylindrical, integral abrasive body 27 having opposed generally cylindrical hollows 29 with a web 31 between the hollows. A central hole in the web 31 snugly receives a suitable metal bushing 33 which in turn is snugly received on a reduced portion 35 of the spindle shaft 37 and is seated against a rigid metal washer 39 telescoped on the reduced portion 35 of the shaft and seated against a shoulder 41 of the shaft. A similar washer 43 is positioned on the reduced portion 35 of the shaft and the assembly is firmly clamped on the shaft by a nut 45 threaded onto a reduced end portion 47 of the shaft 37.

In this embodiment, the one piece abrasive grinding body 27 has a generally cylindrical grinding surface formed into a series of grinding segments or sections 49, each section separated from the other by grooves 51. The outer cylindrical faces of the grinding segments 49 are formed with a convexly arched, preferably radial configuration, as previously described, and the grooves 51 are filled with a relatively non-abrasive filler 53 to the point at which the radial configuration of the grinding segments 49 begins. As previously mentioned with reference to the embodiment of FIGS. 1 and 2, the abrasive sections 49 and the grooves 51 may be proportioned as desired for the intended function of the grinding wheel, as for serrating knife edges, for example.

In both embodiments, the abrasive portion of the wheels may be of any desired abrasive composition. A preferred vitrified composition is as follows:

| | |
|---|---|
| Pure white aluminum oxide, 100 grit size | 1,362 grams |
| Feld spar | 153 grams |
| Ball clay | 175 grams |
| Borax | 55 grams |
| Low melting frit | 30 grams |
| Tragacanth solution | 75 grams; and |
| Coloring agent | 18 grams. |

Composition, by weight, of the filler material is preferably as follows:

| | |
|---|---|
| Ball clay | 35%; and |
| Fine alumina | 65%; |

and is mixed to a slury.

The method of manufacturing the vitrified grinding wheel shown in FIG. 3 preferably includes the following steps. First, the above composition is molded and pressed as is well known in the art, to form the grinding wheel body 27. The wheel is heat set in typical manner, first to a relatively low temperature of about 1500° F., so that the body melts and upon setting is soft enough for cutting the grooves 51 and dressing the outer circumferenial grinding surfaces of the sections 49, while avoiding crumbling of the body 27.

With reference to FIGS. 4 and 5, upon cooling of the body 27 it is mounted on a spindle shaft 55 and is suitably clamped in place between washers 57 by a nut 59, generally as previously described with reference to FIG. 3. A cutter 61 is mounted above the spindle shaft 55 and includes a plurality of circular notched blades 63 suitably mounted on a spindle shaft 65 with spacers 67 of a thickness exactly that of the desired thickness of the abrasive sections 49, the blade assembly being suitably clamped in place by a nut 69 on a threaded end of the shaft 65.

As indicated by the arrow 71 in FIG. 4, the cutter assembly is rotated counter-clockwise at about 17 R.P.M. and is moved downwardly into engagement with the body 27 to cut the grooves. The blades 63 are preferably two and one half inches in diameter and 0.005" thick, and of any suitable blade material. The spacers 67 are approximately one inch in diameter. The grinding wheel body 47 is rotated counter-clockwise as indicated by the arrow 73 in FIG. 4 and at about 7 R.P.M. so that the cutting blades 63 and the grinding wheel body 27 move in opposite directions at their points of contact and at any suitable speeds to avoid excessive wear of the blades. The grinding wheel body is rotated in a trough 74 of coolant to facilitate cutting and to wash out off-fall.

After the grooves 51 are cut into the grinding wheel body 27, the arched configuration of the grinding surfaces of the abrasive segments 49 are formed in typical manner known in the art.

Next, the grinding wheel 25 is cleaned of loose material, which may be accomplished in any suitable manner as by blowing. The wheel is placed in a tank and under vacuum, and the filler material is inserted into the tank to fill the grooves 51. The wheel is then removed from the tank and the excess filler is washed off the wheel leaving the grooves filled to approximately 0.047" inwardly of the outside diameter of the abrasive segments 49.

The grinding wheel is then heated a second time to a higher temperature of approximately 1915° F. for eight hours, whereupon the wheel is at the desired stage of hardness for serrating typical knife edges.

Alternatively, the filler can be a rubber-like compound in which event the grooves are filled with powdered alumina to keep the thin sections 49 from warping when fired the second time. After the second firing the alumina is blown out of the grooves and the rubber compound is then inserted into the grooves to the depth previously described.

In summary, the grooves provided by the separator discs 14 (FIGS. 1 and 2), and the grooves 51 (FIG. 3) permit limited portions of the work piece to enter into the open outer portions of the grooves and to contact only the non-abrasive (or relatively non-abrasive material of the discs 14 (FIG. 1 and 2) or the filler 53 (FIG. 3). Thus, further abrasive action from the abrasive section on the grooves (10 FIGS. 1 and 2, or 49 FIG. 3) on these limited portions of the work piece is effectively prevented, and the radii on the outer grinding faces of the abrasive sections retain their generally radial configuration through continued use. Additionally, the separator discs 14 (FIGS. 1 and 2) and the filler 53 (FIG. 3) support the abrasive sections and strengthen the wheels.

In both embodiments of the grinding wheel, the grooves are preferably five-thousandths of an inch wide (axially of the wheel) in order to avoid forming long points between the scallops of the serrated knife edge. However, in practice the grooves may have a width of up to fifteen-thousandths of an inch, but a width greater than this tends to cause the formation of flats along the serrated edge. Thus, a critical width of the grooves has been found to be between five-thousandths and fifteen-thousandths of an inch, with a five-thousandths inch groove being preferable.

While this invention has been described with reference to particular embodiments in a particular enviornment, various changes may be apparent to one skilled in the art and the invention is therefore not to be limited to such embodiments or enviornment except as set forth in the appended claims.

What is claimed is:

1. A serrating grinding wheel comprising, means for forming a series of spaced apart, generally pointed teeth along a cutting edge of a knife blade, or the like, said means including a plurality of grinding material sections, each section having a grinding surface which is convex and generally semicircular in cross section axially of the wheel for forming depressions in the cutting edge between the pointed teeth, the grinding sections are of a width to provide the desired length of serration in the finished knife, and means increasing the useful grinding life of the grinding surfaces, the last said means defining annular grooves, one between each of adjacent ones of said grinding surfaces, said grooves providing areas in which the teeth points are formed, said grooves being of a width substantially less than the width of the grinding surfaces as measured axially of the wheel in the range of about five thousandths to fifteen thousandths of an inch, and said grooves being substantially devoid of an effective grinding material and extending inwardly of the wheel from between each of said grinding surfaces and spacing said grinding surfaces apart axially of the wheel in which said grooves are at least partially filled with a material which is relatively non-abrasive when compared with said sections and the outer surfaces of the filler material are spaced inwardly from said grinding surfaces during normal use of the wheel.

2. A grinding wheel as set forth in claim 1 in which the grinding sections are about ninety-five thousandth inch thick, surfaces during normal use of the wheel.

3. A grinding wheel as set forth in claim 2 in which said grinding sections are in the general form of discs, and the filler material is in the general form of discs, one between each of the grinding discs.

4. A grinding wheel as set forth in claim 3 in which the grinding discs have about a one hundred grit size and are about six inches in diameter, and said discs are mounted on a hub and are facially secured to each other and to said hub.

5. A grinding wheel as set forth in claim 2 in which said grinding sections are part of an integral abrasive body of the wheel, and said filler material is received in said grooves.

6. A grinding wheel as set forth in claim 5 in which the wheel is approximately six inches in diameter, the grinding sections have about a one hundred grit size, and the grooves are about three-eights inch deep.

* * * * *

UNITED STATES PATENT AND TRADEMARK OFFICE

CERTIFICATE OF CORRECTION

PATENT NO. : 4, 151,685

DATED : May 1, 1979

INVENTOR(S) : Joseph G. Frangipane

It is certified that error appears in the above-identified patent and that said Letters Patent are hereby corrected as shown below:

Column 7, Claim 2, Line 3. Delete;
"Surfaces During Normal Use of the Wheel"

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*